United States Patent [19]

Singhi

[11] Patent Number: 4,490,050

[45] Date of Patent: Dec. 25, 1984

[54] MASTER/SLAVE CLOCK SYSTEM

[75] Inventor: Dilip T. Singhi, Skokie, Ill.

[73] Assignee: Rauland-Borg Corporation, Chicago, Ill.

[21] Appl. No.: 489,859

[22] Filed: Apr. 29, 1983

[51] Int. Cl.[3] ..... G04C 11/00; G04C 13/08

[52] U.S. Cl. ..... 368/46; 368/59

[58] Field of Search ..... 368/46, 59, 57, 52

[56] References Cited

U.S. PATENT DOCUMENTS

| | | | |
|---|---|---|---|
| 3,643,420 | 2/1972 | Haydon | 368/59 |
| 3,690,059 | 9/1972 | Haydon | 368/52 |
| 3,811,265 | 5/1974 | Cater | 368/52 |

OTHER PUBLICATIONS

Dukane Corporation brochure entitled "Double Faced Secondary Clock 24DW200, 24DC200".

Simplex Time Recorder Co. brochure entitled "Celestra LCD Direct Read Indicating Clocks".

*Primary Examiner*—Bernard Roskoski

*Attorney, Agent, or Firm*—Leydig, Voit, Osann, Mayer & Holt, Ltd.

[57] ABSTRACT

A master/slave clock system including a slave clock configured for inexpensive and reliable control from the master. Each slave clock has an unregulated d-c supply adapted to be supplied with a-c power from the master clock. Threshold switching means in each slave clock is coupled across the d-c supply to sense an abnormally low d-c voltage level intentionally created by lowering the a-c supply level from the master. The threshold switching means switches the clock from the normal operating mode to the set mode where time is incremented at a predetermined rate for a duration controlled by the master clock in order to controllably set all slave clocks in the system to the correct time of day. The system conveniently allows all slaves to be reset to the same time when time is reset at the master, provides for automatic recovery after power failures, and provides a convenient means for automatically resynchronizing all slave clocks twice a day.

10 Claims, 3 Drawing Figures

START
POWER FAILURE RECOVERY
SET TIME
SYNCHRONIZE
100
INTERRUPT AC POWER
101
RE APPLY AC POWER
110
POWER FAILURE
111
POWER RECOVERY
120
IS IT 12:01?
NO
CONTINUE
YES
121
INTERRUPT AC POWER
122
RE APPLY AC POWER
102
AC POWER APPLIED AT REDUCED LEVEL
103
$T_{ERR} = T_{ACT} - 12:00$
104
$T_{ADJ} = \frac{T_{ERR}}{T_{RATE}} + \frac{T_{ADJ}}{T_{RATE}}$
105
MAINTAIN AC POWER AT REDUCED LEVEL FOR $T_{ADJ}$ SECONDS
106
RETURN AC POWER TO NOMINAL LEVEL
END

MASTER/SLAVE CLOCK SYSTEM

This invention relates to master/slave clock systems, and more particularly to means for controllably setting the slaves from the master.

Master/slave clock systems are those in which a plurality of slave clocks are distributed throughout a given area, but are all controlled from a single master clock or controller. Typically, each slave clock has its own timing mechanism, but responds to the master for purposes of setting, synchronizing, and the like. Thus, for example, after a power failure it is not necessary to reset each individual slave clock, but by manipulating the master clock all of the slaves can be returned to the correct time of day. Master/slave clock systems are useful, if not necessary, in various applications such as schools, hospitals, or airports where a large number of clocks are distributed throughout the facility. In those applications, the slave clock has several advantages: there is no need to set each clock when time is being reset or after power failure, and the slave clocks can be corrected by the master clock to keep them synchronized with the master and thus all telling the same time.

Earlier forms of master/slave clock systems utilized analog slave clock with mechanical apparatus for remote control from the master. Typically, upon signal from the master, a ratchet in each slave clock would be engaged to drive the minute hand toward a predetermined time whereupon it would be disengaged by a cam or other mechanicam. That approach required not only an analog clock, but one with additional mechanical complexity to respond to the signal from the master.

More modernly, digital clocks are being used as slaves, but setting or resetting again remains a problem. In some approaches, correction pulses have been applied to the d-c power supply lines or on separate lines for control by the master. Pulse control systems on unshielded lines, or on power lines, can pose noise problems, which require either complicated and expensive noise rejecting circuitry at each slave, or potentially inaccurate setting. Also, separate correction lines add an extra element of installation complication and expense.

It will be appreciated that typically, the slave clocks referred to above are specially designed and configured to operate in the master/slave environment. There are, however, commercially available digital clocks, comparatively inexpensive, intended to run autonomously. Many of such clocks include a power up initialization circuit which sets the clock to a predetermined time, such as 12:00 upon the initial application of power. In addition, such clocks often have fast set and slow set manual controls for adjusting the time. For example, upon activation of the slow set manual control, the time is advanced at a rate such as 1 minute per half second, while the fast set control typically operates at a quicker rate. Those controls are available to allow a user to set the time manually after application of power.

In view of the foregoing, it is a general aim of the present invention to adapt an inexpensive digital clock of the type referred to for use in a master/slave environment.

More particularly, it is an object of the present invention to provide a digital slave clock for a master/slave clock system which is at least as reliable while being simpler and less expensive than pulse controlled digital clocks of the prior art.

A further object of the present invention is to provide a slave clock for a master/slave clock system with control means for responding to the master which are simple and inexpensive on the one hand, and possess a high degree of noise immunity on the other.

In another aspect of the invention, it is an object to provide a method for operating such a master/slave clock system for simply and automatically maintaining all slave clocks in synchronism at the correct time of day.

BRIEF DESCRIPTION OF THE FIGURES

Other objects and advantages will become apparent from the following detailed description when taken in conjunction with the drawings, in which.

While the invention will be described in connection with a preferred embodiment, there is no intent to limit it to that embodiment. On the contrary, the intent is to cover all alternatives, modifications and equivalents included within the spirit and scope of the invention as defined by the appended claims.

Figure 1:
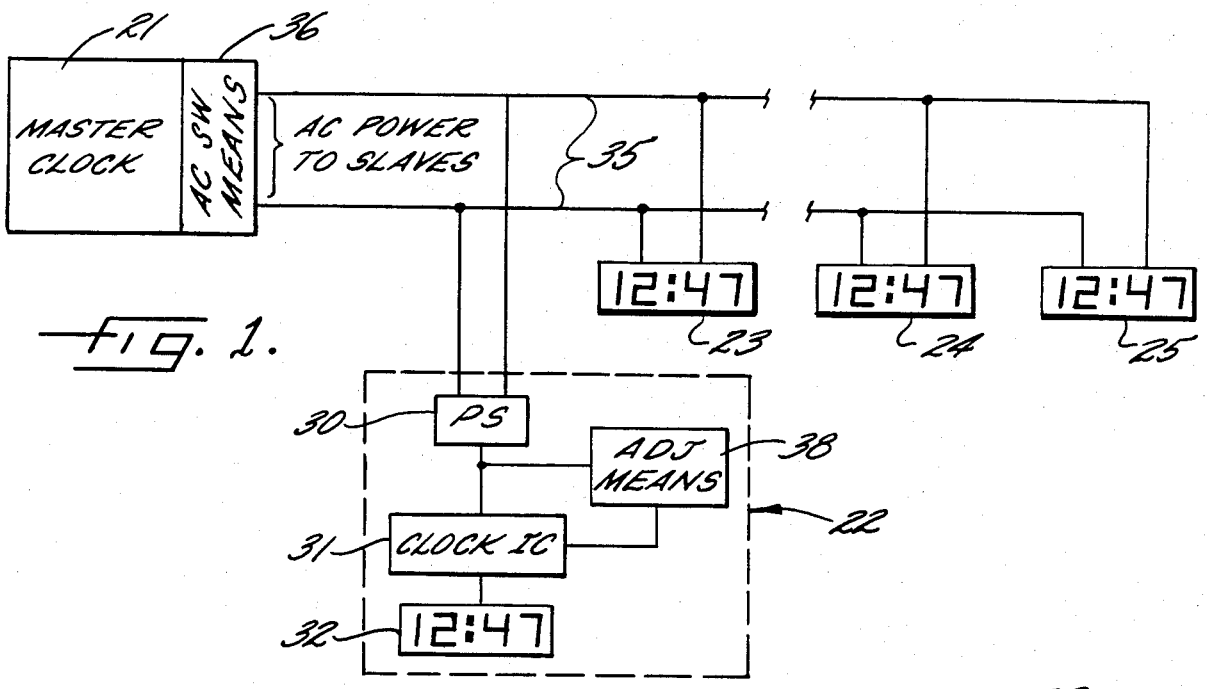
FIG. 1 is a schematic diagram illustrating a master/slave clock system exemplifying the present invention.

Turning now to the drawings, FIG. 1 shows a master/slave clock system generally indicated at 20 including a single master clock 21 and a plurality of digital slave clocks 22–25. Slave clock 22 is shown in somewhat greater detail, it being appreciated that the remaining slave clocks are similarly configured. While only four slave clocks are shown, it will be understood that a much greater number is usually provided.

As suggested above, the clock module on which the slave clock is based is a conventional, commercially available digital clock intended to operate autonomously when connected to an a-c supply. To that end, the clock, for example clock 22, includes a power supply 30 to be driven from an a-c power source, a clock integrated circuit 31 and a display 32. As suggested above, a fast set/slow set switch 33 (FIG. 2) is provided to manually adjust the clock to the current time of day. When a positive signal is applied to the slow set input, the internal circuitry of the clock integrated circuit 31 increments the time at a rate more rapid than usual, such as 1 minute per half second. Thus, if one were to depress the slow set pushbutton 32 for a period of 4 seconds, the displayed time would advance by 8 minutes. The 1 minute per half second advance rate is selected as convenient, it is apparent that other predetermined rates can be utilized, so long as the rate is known.

In accordance with the present invention, individual a-c supplies are dispensed with and power to all of the slave clocks in the system is provided on power lines 35 supplied under the contol of the master clock 21. It is seen that each of the clocks 22–25 are connected in parallel across the power lines 35. In normal operation, the clocks operate as is conventional, with the power supply 30 converting a-c power to operating d-c voltage to supply the clock integrated circuit 31 which maintains current time of day and also to power the display 32 which displays the current time of day.

However, in order to control the slave clocks from the master station, the master clock 21 has associated therewith a-c switch means 36 which uses the a-c power lines 35 to set, reset and synchronize all slave clocks in the system. The slave clocks need not have the capability to signal the master clock as to the time they are displaying, since the master can bring all slaves to the same time simply by briefly interrupting the power by opening switch means 36. Upon reapplication of power, all of the clocks will be initiated at the predetermined time, taken in the current example as 12:00. Additionally, by means now to be described, the master clock 21 operating through switch means 36 modifies the power supply to all slave clocks in order to simultaneously increment such clocks to a desired time.

To respond to such modified power supply, each slave clock is provided with adjustment means 38 coupled across the output of the power supply 30 of the associated slave clock, for simply and inexpensively providing the slave clock the ability to respond to commands issued by the master clock.

Figure 2:
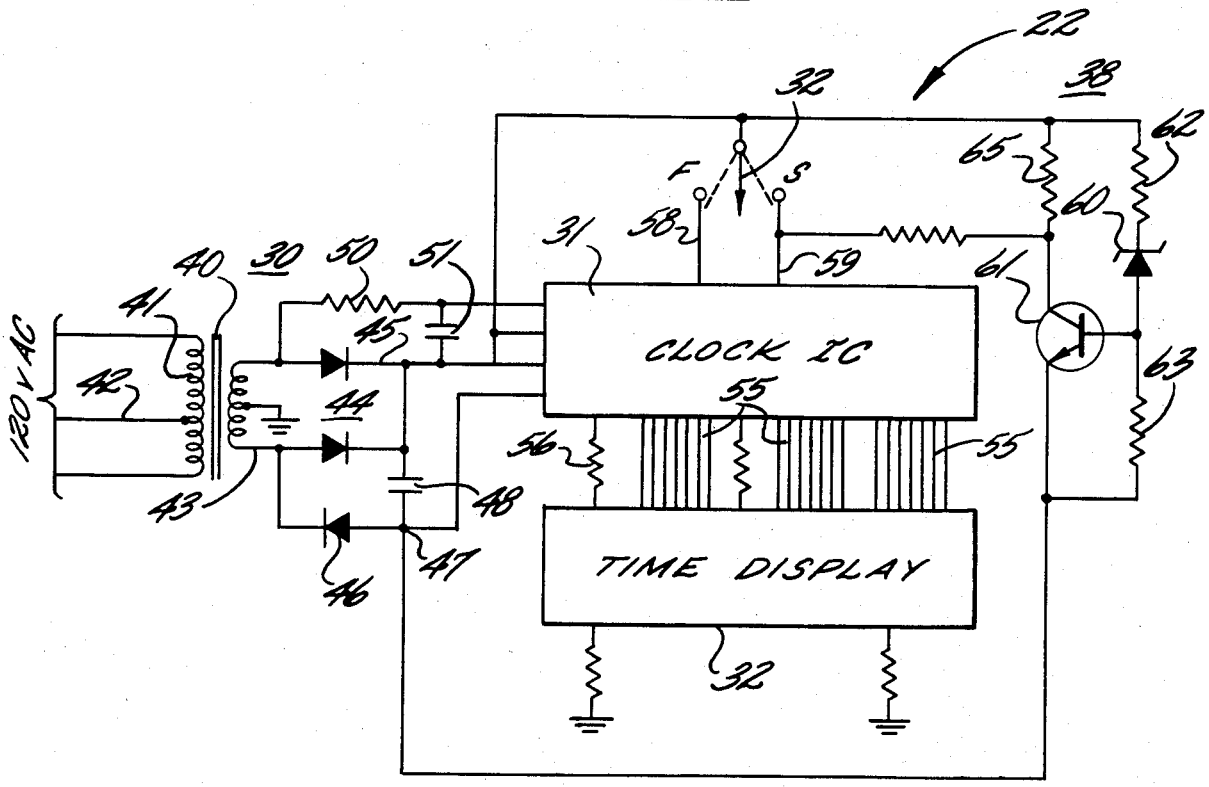
FIG. 2 is a schematic diagram illustrating the circuitry of a slave clock.

FIG. 2 illustrates one of the slave clocks, such as clock 22, in greater detail. The power supply 30 has an input power transformer 40 whose primary winding 41 is adapted for connection across the power lines 35 (FIG. 1). In the exemplary embodiment, the full primary is used in 120 volt nominal systems, whereas a tap 42 is provided for use with 24 volt a-c nominal systems. Connected to the secondary 43 of the transformer 40 is a full wave bridge 44 connected to a positive supply bus 45 and a half wave bridge 46 for supplying a negative bus 47. A capacitor 48 is connected across the buses for purposes of filtering. The power supply has no voltage regulator. Both positive and negative buses are connected to the clock IC 31 which is preferably a Hitachi HD-38991A commercially available clock integrated circuit. A time base is supplied to the clock integrated circuit 31 via a resistor 50 and filtering capacitor 51 connected to the a-c side of the bridge 44. The clock 31 responds to the 60 cycle time base to increment internal registers to thereby keep track of the current time of day. For purposes of displaying the time of day, the clock circuit 31 is connected to the time display 32. The exemplary display is of the seven segment LED variety, although other types can be utilized. Accordingly, connections between the clock circuit 31 and display 32 include three groups of seven connections 55 for controlling the three lower order digits and a resistive connection 56 for controlling the most significant digit which can be either blank or one. Other biasing and current limiting resistors are also illustrated.

Internal to the clock circuit 31 is a standard power-on reset circuit which senses the application of a-c power to initialize the internal registers at a predetermined number. One popular scheme initializes the registers at 12:00, and that will be used as an example in the present application, although it is appreciated that other initialization times can be accommodated. Also internal to the clock circuit 31 is a setting means having a pair of terminals 58, 59 for fast and slow setting. As illustrated by the switch 32, those terminals can be manually connected to the positive supply 45 for activating the appropriate terminal. Upon applying power to, for example, the terminal 59, internal dividers within the clock circuit 31 are adjusted to increment the internal time registers, not by one minute per 60 seconds, but by, for example, one minute per one-half second. Thus, the internal time can be slewed at a reasonable rate to adjust the displayed time for setting.

In practicing the invention, the adjustment means 38 is coupled across the power supply terminals 45, 47 and includes threshold switching means, shown herein as zener diode 60 and transistor 61 for responding to an abnormally low, but intentionally created, d-c voltage from the power supply 30. More particularly, the circuitry associated with transistor 61 includes the zener diode 60 and biasing resistors 62, 63 connected across the power supply and to the base of the transistor. When the power supply is at its nominal level, the zener diode is conductive, causing the transistor 61 to conduct. The collector of the transistor 61 is connected by current limiting resistors 64 to the slow set terminal 59 of the clock circuit 31. Accordingly, when the transistor 61 is conducting as in normal operation, the slow set terminal 59 is maintained at a low level, disabling the internal setting circuitry. However, when the a-c switch means 36 provides a reduced level of a-c power to the string of slave clocks, since there is no voltage regulator in the d-c supply, the d-c voltage level will collapse to a level below nominal, and that will be sensed by the adjustment means 38 including the threshold switching means. In short, when the voltage level is thus reduced, the zener diode 60 will cease conducting, causeing the transistor 61 to switch off, providing a path for current flow through collector resistor 65 and current limiting resistor 64 to the slow set terminal 59. The setting means will thereby be activated and the clock circuit 31 will increment the retained and displayed time at the predetermined adjusting rate. The length of time during which the a-c power supply is maintained at the low level will determine the length of time (and thus the total increment) during which the setting means is maintained in the activated condition. When the adjustment required by the master clock has been completed, it operates the switch means 36 to return the a-c supply to its nominal level, that being sensed by the zener diode 60 which returns transistor 61 to the conductive condition, terminating the activation of the setting means.

The basic master clock itself is preferably of the type described and claimed in Singhi U.S. Pat. No. 4,387,420 entitled Programmable Clock and assigned to the same assignee as the present invention. The construction of the a-c switch means 36 associated with master clock 21 has not been illustrated in detail since its construction can be rather straightforward. More particularly, a conventional autotransformer can be associated with relay means to apply nominal 120 volt a-c power to the lines 35 in normal operation, but to utilize a tap at about 85 volts for application of a-c power at reduced voltage level. In one embodiment of the invention, the a-c supply including autotransformer was configured as a separate module to be controlled by suitable means within the master clock. The elements have been shown in the drawings as unitary for purposes of simplicity. By means of this inexpensive modification, as well as the addition of an adjustment means 38 to each slave clock, conparatively inexpensive independent clocks are converted to slave operation to provide a master/slave clock system which is both accurate and cost effective.

Figure 3:
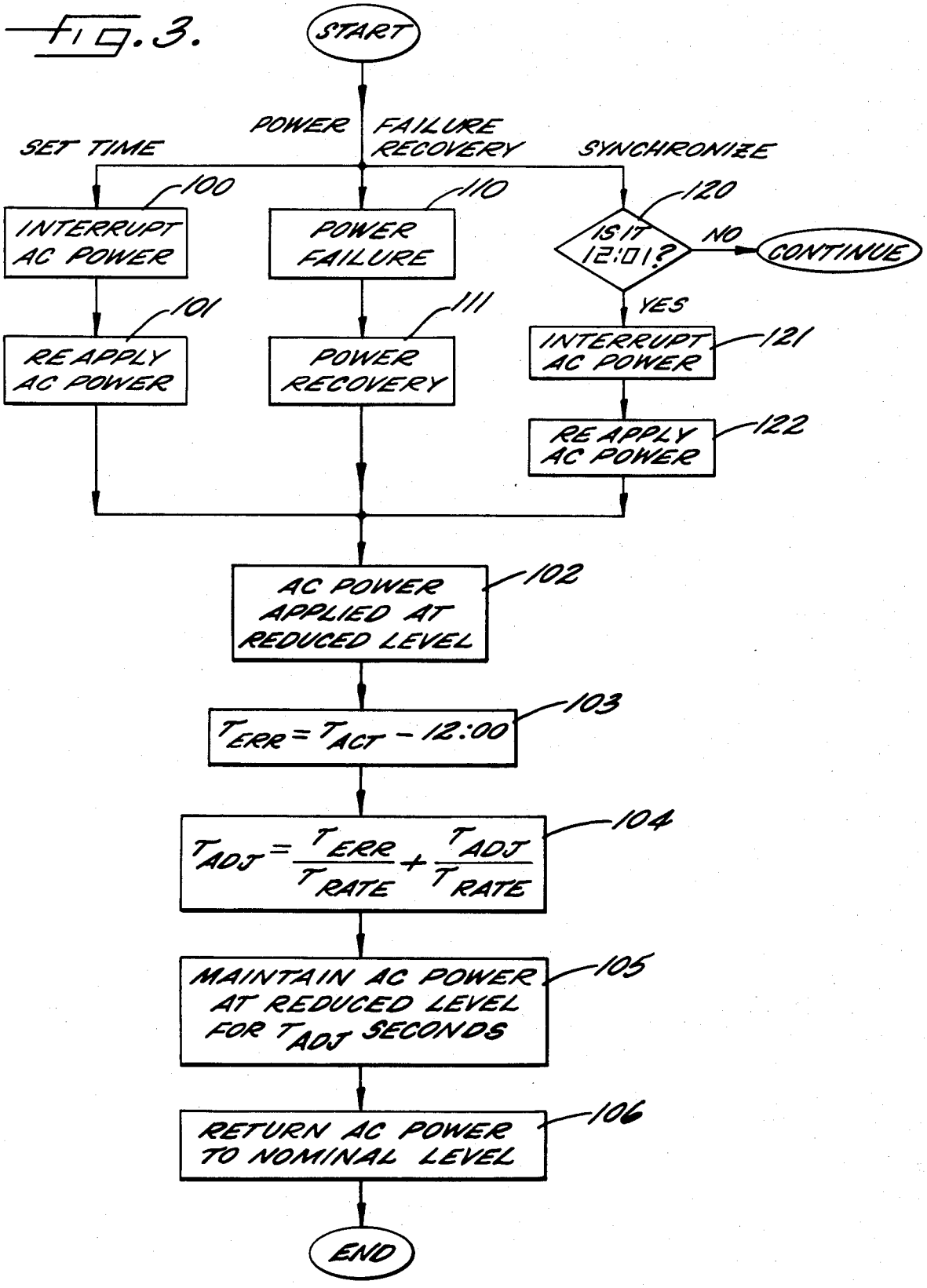
FIG. 3 is a flow chart illustrating the manner of operating the master/slave clock system to maintain the slave clocks in synchronism at the correct time of day.

Turning to FIG. 3, there will be illustrated the method aspects of the present invention. While the slave clocks in the system spend the majority of their time operating independently, counting the time base and displaying the actual time, control can be exercised by the master in a number of modes, three of which are illustrated in FIG. 3. A first mode identified as "set time" is used whenever it is desired to change the time stored within the master clock and display that changed time at the slaves. Examples of such use are upon initial installation and when changing to or from daylight savings time.

First of all, in order to assure that all slave clocks in the system are set to the same time, and that that time is known to the master without feedback, the method steps 100, 101 are performed to interrupt the a-c power then, after a brief delay of say several seconds, reapply the a-c power. In the exemplary embodiment, that initializes each slave clock connected to the power lines to 12:00. In performing the step 101, however, rather than reapplying a-c at its nominal level, the step 102 assures that the power is applied at a reduced level. In 120 volt nominal systems, it is preferred to reapply power at about 85 volts, and in 24 volt systems at about 16 volts. However, other values can be used if desired.

Because the step 102 accomplishes reapplication of a-c power at reduced level, the adjustment means 38 (FIGS. 1 and 2) senses the reduced d-c supply level, and the zener diode 60 remains nonconductive, switching transistor 61 off and thereby applying the positive supply to the slow set means via terminal 59. Thus, each slave clock in the system, having first been reset to 12:00 begins incrementing time at the predetermined rate, such as 1 minute per half second. Since all slave clocks have the same 60 cycle time base from the same source, such incrementing is in synchronism.

In order to determine the amount of time to continue the incrementing operation, steps 103, 104 are performed. In step 103, the time error is calculated by subtracting the initialization time, 12:00 in the example, from the actual time stored in the master clock. The master clock thereby determines an error time $T_{ERR}$ and divides that by the known incrementing rate of the slave clocks to determine a time $T_{ADJ}$ which is the time interval necessary to incremental slave clocks to the actual time. The second term in step 104 is intended to accommodate long adjustments, those of about one minute or more and add an adjustment factor to account for the adjusting time itself. A step 105 serves to maintain the a-c power at the reduced level for the $T_{ADJ}$ interval, whereupon a step 106 returns a-c power to the nominal level. It will be recalled that the return of power to the nominal level returns the output voltage of the unregulated d-c supply to its nominal level, which in turn causes zener diode 60 to conduct, returning transistor 61 to the conductive condition and removing the signal from the slow set terminal 59 of the clock. At that point, each of the slave clocks in the system is displaying the same time, that commanded by the master, and thereupon utilizes the 60 cycle time base supplied from the master to continue to count and display the current time of day.

As described in the aforementioned Singhi application, the master clock is preferably provided with a battery backup so that the current time of day is maintained in the presence of power failures. The central branch illustrated in FIG. 3 termed "power failure recovery" is intended to automatically restart all slave clocks in the system at the correct time of day after a power failure. The power failure is illustrated at step 110, and the subsequent recovery at step 111. Steps 102–106 are performed in the sequence described above to initialize all clocks at the predetermined time, 12:00 in the example, to calculate the error between the actual time of day and the initialized time, to calculate an adjustment time, taking into account the error time and the incrementing rate of the slave clocks, and to maintain the a-c power at the reduced level for the calculated time, whereupon full voltage is reapplied and system operation continues.

Because the slave clocks are inexpensive and less than perfect, there is a chance that one or more of them can slip from synchronism by one or more minutes. It is appreciated that it can be disconcerting to view two clocks in the same room displaying a different time. Accordingly, the system is provided with means for automatically resynchronizing all slave clocks at a predetermined time. Perferably, the resynchronization time is selected near the initialization time for the slave clocks. Accordingly, in the present example, a test is continually performed to determine when the actual time reaches 12:01. At that point, a test 120 is satisfied and the steps 121, 122 performed to temporarily interrupt a-c power, then reapply a-c power at the reduced level. All of the slave clocks in the system reinitialize at 12:00. The error is calculated in step 103 to determine that there is a 1 minute error between the actual time and the initialized time. The step 104 is performed to determine that at the examplary rate, the power should be maintained at the reduced level for one-half second. The step 105 then maintains power at the reduced level for the one-half second, whereupon the step 106 returns it to normal level and the clocks continue to operate in the conventional manner. That step can be performed twice a day to assure that all clocks continue to run in synchronism.

In view of the foregoing, it will by now be apparent that what has been provided is a simple and inexpensive master/slave clock system in which a conventional commercially available clock can be modified with adjustment means to respond to the commands issued from the master on the a-c power lines. A reliable system is achieved without the complexity and expense typically associated with master/slave clock systems.

I claim:

1. A slave clock for control by a master clock in a master/slave clock system wherein the master clock supplies a-c power to all slave clocks connected thereto, said slave clock comprising, in combination, an unregulated d-c supply for receiving a-c input power from the master and for producing d-c power from the master and for producing d-c power at a nominal voltage level when the a-c supply is at a nominal a-c level, setting means for responding to a first signal level to remain deactivated and for responding to a second signal level to increment a time display at a predetermined rate, adjustment means including a threshold switch responsive to the d-c supply for producing an output signal at the first signal level when the d-c supply is at the nominal level and for producing an output signal at the second signal level when the d-c supply is below the nominal level, and means coupling the adjustment means to the setting means whereby a reduced a-c voltage level from the master clock will reduce the output level of the unregulated d-c supply for control of the setting means.

2. The combination as set out in claim 1 wherein the threshold switch includes a zener diode for sensing the voltage level of the d-c supply.

3. The combination as set out in claim 1 wherein the slave clock further includes initialization means for setting the clock to a predetermined time upon application of a-c power.

4. A master/slave clock system comprising, in combination, a master clock having an a-c output for applying power to a plurality of slave clocks, each slave clock including an unregulated d-c supply for receiving a-c input power from the master clock and for producinng an output at a nominal d-c voltage level when the a-c power supplied by the master clock is at rated level, each slave clock including setting means for responding to a first signal level to remain deactivated and for responding to a second signal level to increment a time display at a predetermined rate, each slave clock having adjustment means including a threshold switch responsive to the d-c supply for producing an output signal at the first signal level when the d-c supply is at its nominal level and for producing an output signal at the second signal level when the d-c supply is below the nominal level, means coupling the adjustment means to the setting means, and means at the master clock for reducing the voltage level of the a-c supply, thereby to reduce the d-c level of the unregulated supplies to activate the adjustment means for synchronous operation of the settng means of all coupled slave clocks.

5. The combination as set out in claim 4 wherein the threshold switch includes a zener diode for sensing the voltage level of the d-c supply.

6. The combinaton as set out in claim 4 wherein the slave clock further includes initialization means for setting the clock to a predetermined time upon application of a-c power, and means at the master clock for interrupting and reapplying a-c power to initialize all coupled slave clocks.

7. A method of remotely setting to the correct time all of the slave clocks in a master/slave clock system having a master clock and a plurality of slave clocks connected thereto to receive a-c power at a nominal level, each slave clock including means for initiating a time display at a predetermined time upon the application of a-c power, each slave clock also including setting means when activated for incrementing the time display at a predetermined rate, the method comprising the steps of, terminating the a-c supply to the slave clocks, after an interval initiating the a-c supply to the slave clocks to restart all clocks at said predetermined time, accomplishing the immediately foregoing step with a reduced a-c voltage level lower than the predetermined level, determining the time interval which will increment the slave clocks to the correct time at said predetermined rate, maintaining the reduced voltage level for the determined time, responding to the reduced voltage level to activate said setting means thereby to increment all slave clocks at said predetermined rate, and at the termination of said determined time raising the level of the a-c supply to the predetermined level, thereby to de-energize the setting means and leave all slave clocks set at the correct time.

8. The method as set out in claim 7 wherein the step of terminating the a-c supply includes a power failure, and the step of initiating the a-c supply includes a power recovery.

9. The method of claim 7 in which the steps of terminating and initiating the a-c supply are accomplished by resetting the time at the master clock.

10. The method of claim 7 in which the steps of terminating and initiating the a-c supply are accomplished automatically at the master clock when the correct time is approximately said predetermined time, thereby to automatically resynchronize all slave clocks.

* * * * *